United States Patent [19]

Tropea

[11] 4,218,894

[45] Aug. 26, 1980

[54] PIERCED EARRING WITH ADJUSTABLE ORNAMENT

[75] Inventor: Amilcare R. Tropea, Providence, R.I.

[73] Assignee: Lang Jewelry Company, Providence, R.I.

[21] Appl. No.: 950,239

[22] Filed: Oct. 10, 1978

[51] Int. Cl.[2] ..... A44C 7/00

[52] U.S. Cl. ..... 63/13; 63/29 R; 63/31

[58] Field of Search ..... 63/12, 13

[56] References Cited

U.S. PATENT DOCUMENTS

| | | | |
|---|---|---|---|
| 263,755 | 9/1882 | Braverman | 63/12 |
| 502,801 | 8/1893 | Wodiska | 63/13 |
| 776,969 | 12/1904 | Voight | 63/20 UX |
| 2,961,855 | 11/1960 | Newman | 63/15.65 |
| 4,086,786 | 5/1978 | Ritter | 63/13 |

FOREIGN PATENT DOCUMENTS

| | | | |
|---|---|---|---|
| 133446 | 10/1879 | France | 63/12 |

*Primary Examiner*—F. Barry Shay

*Attorney, Agent, or Firm*—Salter & Michaelson

[57] ABSTRACT

An earring specially adapted for pierced ears is disclosed. Apart from the normal ornament, post and retaining clutch provided in such pierced earring constructions, the present construction includes a secondary ornament mounted to be both rotatable with respect to its mounting means and adjustably slidable towards and away from the first ornament so as to be positionable below the wearer's earlobe. Such is accomplished by the provision of a secondary clutch attached to the primary clutch and in which a post portion of the secondary ornament is rotatably and slidably secured. In this fashion, novel and unique ornamentation effects may be provided on the wearer's ear.

9 Claims, 7 Drawing Figures

PIERCED EARRING WITH ADJUSTABLE ORNAMENT

BACKGROUND AND SUMMARY OF THE INVENTION

This invention relates to earring constructions and particularly earrings which are adapted for use in conjunction with a pierced earlobe opening. Such earrings are noramlly referred to as post type or pierced earrings and generally include an ornament provided at one end of a post and a clutch member adapted to frictionally engage the other end of the post after the post has been inserted through the pierced earlobe opening. In this manner then, the earring is retained on the earlobe of the wearer.

Part of the decorative effect which may be achieved with earrings of this type is dependent on the particular placement of the pierced ear opening vis-a-vis the remaining portions of the wearer's earlobe. This is especially so of ornamentation in which a particular portion of the ornament is to be placed closely adjacent or touching the bottom or other predetermined area of the wearer's ear. It is, therefore, a primary object of the present invention to provide an earring construction which provides a novel measure of adjustability such that the overall ornamental effect achieved thereby is less dependent on the particular location of the wearer's pierced ear opening.

A further object of the present invention is the provision of an earring construction in which secondary ornamentation portions thereof may be substituted for one another so as to achieve various ornamental effects without the necessity of purchasing an entirely new earring.

These and other objects of the present invention are achieved by providing a standard pierced earring construction having an ornament, a post connected thereto and a clutch member adapted to receive the post after having passed through the wearer's ear opening. In addition to such construction, a secondary clutch secured to the primary clutch is provided. This secondary clutch is adapted to adjustably receive a secondary post which in turn is provided with a secondary ornament such that the secondary ornament is movable towards and away from the primary ornament so as to provide relative adjustability between both ornaments individually and collectively with respect to the wearer's ear.

It is common to utilize earring constructions in which the total ornamentation or at least a portion thereof is removable and may be substituted with alternate ornamentation. Also, a somewhat related earring construction of which applicant is aware includes that disclosed in U.S. Pat. No. 263,755 to Braverman in which a pierced earring includes ornamental portions dependent from a clutch member so as to be positioned on the bottom of the wearer's lobe. The ornamentation of such earring is not, however, provided with the measure of adjustability necessary to accomplish the objects of the present invention. The above set forth prior art discussion and patent citation constitutes applicant's Prior Art Statement and in that regard, a copy of U.S. Pat. No. 263,755 is enclosed with this application.

Other objects, features and advantages of the invention shall become apparent as the description thereof proceeds when considered in connection with the accompanying illustrative drawing.

DESCRIPTION OF THE INVENTION

Figure 1:
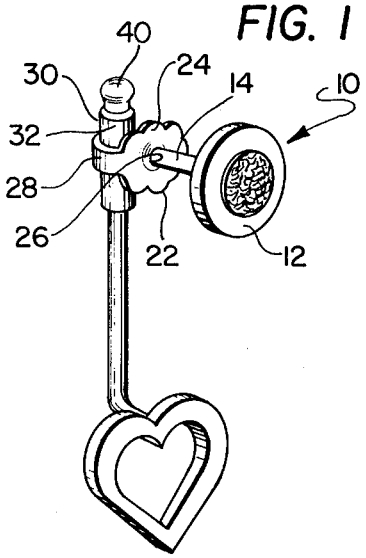
FIG. 1 is a perspective view showing the earring construction of the present invention.
Figure 2:
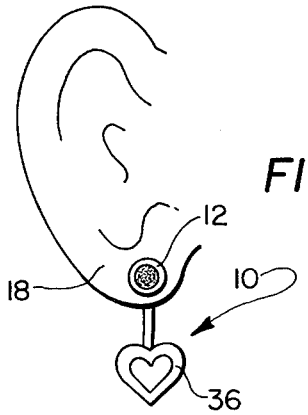
FIG. 2 is a side elevational view showing the earring shown in FIG. 1 positioned on the ear of the wearer.

The earring 10 include a first or primary ornament 12 of any suitable appearance and having attached thereto and dependent from the rear surface thereof a first or primary post 14. Such post 14 is adapted to pass through the pierced ear opening 16 of a wearer's earlobe 18. The opposite end 20 of the post 14 is in turn adapted to be received by a primary or first clutch 22 positioned to the rear of the wearer's earlobe and thus in a conventional manner, support the earring 10 from the ear of the wearer.

Clutch 22 includes a plate 24 in turn provided with a generally centrally disposed opening 26 through which the post 14 is adapted to extend. The clutch 22 is further provided with means for frictionally engaging the sides of the post 14 that extend through the opening 26 so as to permit the frictional placement and removal of the earring with respect to the wearer's ear. Such means as shown in the drawing include a pair of spring loops or curled flanges 28 which rearwardly extend in the loop configuration depicted so as to present portion thereof in opposition to each other and adapted to frictionally contact the sides of the post 14. This type of frictional clutch is well known in the art.

The cutch 22 is additionally provided with a secondary clutch 30 in the form of a longitudinally extending sleeve 32 open at both ends thereof and provided internally with a resilient bushing or tube 34. Such sleeve 32 is disposed within one of the curled flanges 28 and is held with respect thereto either by frictional engagement or by a suitable attachment mechanism, including soldering, brazing and the like.

A second ornament 36 is attached to a post 38 and the other end of the post frictionally slidably received within the bushing 34 of the sleeve 32. In this manner, the second ornament 36 may be moved towards and away from the first ornament 12 such that the distance between them may vary dependent upon the positioning of the first ornament with respect to the wearer's ear. Various ornamental effects can be achieved by this adjustability of the first and second ornaments with respect to each other. For instance, to achieve an effect wherein the second ornament is to be positioned slightly below the wearer's ear regardless of the position of the first ornament, the following adjustments may be made: If the first ornament is positioned relatively high upon the wearer's earlobe due to the location of the pierced ear opening in such location, the secondary ornament may be slidably moved away from the first ornament to a position spaced beneath the lower terminal edge of the wearer's lobe or alternately towards the first ornament should the wearer's pierced ear opening be positioned lower on the ear.

Figure 3:
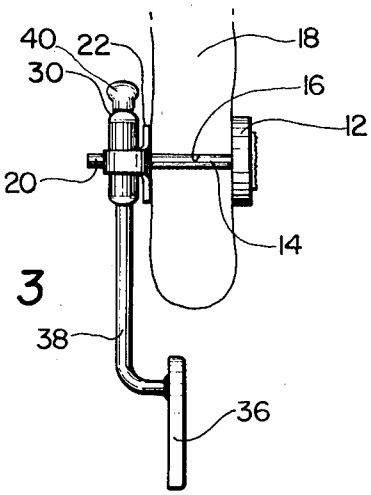
FIG. 3 is a side elevational view thereof.
Figure 4:
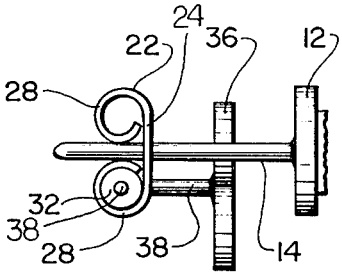
FIG. 4 is a top plan view of the earring construction shown in FIG. 1.
Figure 5:
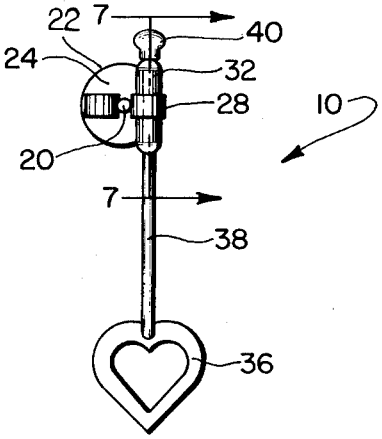
FIG. 5 is a rear elevational view thereof.
Figure 6:
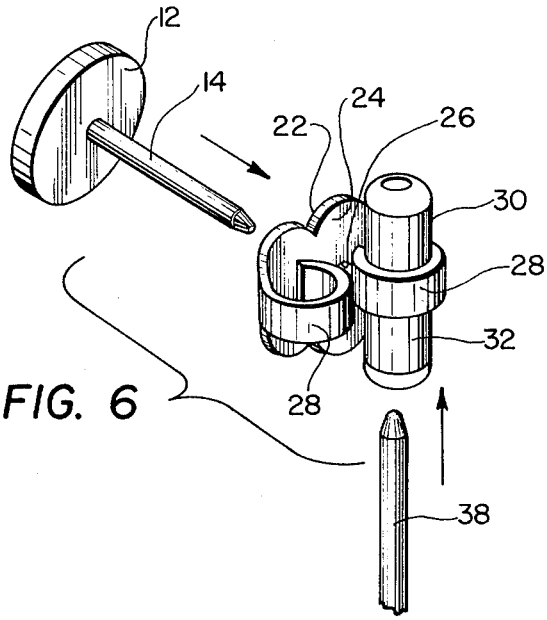
FIG. 6 is a partial rear perspective view thereof with component portions of the earring construction in exploded position.
Figure 7:
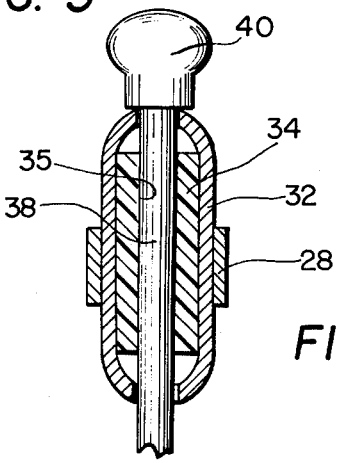
FIG. 7 is a sectional view taken along the line 7—7 of FIG. 5.

Additionally, the secondary ornament may be entirely removed from the clutch 30 and a different second ornament replaced therein so as to achieve additional flexibility in the use of the earring construction of the present invention thus eliminating the necessity of purchasing an entirely new earring in order to achieve different ornamental effects. Generally, the second post 38 is of L-shaped configuration such that the second ornament 36 may be disposed generally beneath the wearer's earlobe as shown in FIG. 3. The cross-sectional configuration of the post is generally circular and of a diameter slightly greater than that of the bore 35 of bushing so as to ensure a snug frictional engagement therebetween. The upper end of the post 38 may also be provided with a press fit cap 40 of a lateral dimension greater than that of the upper opening of the sleeve so as to prevent the post from sliding out of such sleeve and becoming accidentally detached therefrom. It should be pointed out, however, that the inclusion of cap 40 is essentially a back-up feature and that the positioning of the post with respect to the overall earring construction is accomplished by the frictional engagement of the post with the bushing 35. Such cap 40 is secured to the post end after a portion of the post has been inserted through the sleeve. The post and cap may also be threadably connected to each other rather than by press fit so as to prevent the post from sliding out of such sleeve and becoming accidentally detached therefrom. Also, inasmuch as both the first and second posts 14 and 38 are respectively frictionally engaged by their clutches 22 and 30, it is possible to rotate both the first and second ornaments with respect to each other as well as with respect to the wearer's ear, although such feature may be partially or fully eliminated by making either or both of the posts of a cross-sectional configuration which will prevent such rotation, i.e., by making either or both of the posts and the bore or opening in which they are adapted to extend of triangular, square, etc., configuration. It should also be brought out that while the longitudinal orientation of the sleeve forming the clutch 30 is vertically disposed, such may be otherwise disposed with regard to the clutch 22 and may be attached thereto in a different location such that the second ornament will extend at other angles from the first ornament than that depicted. In the case where the first post 14 is rotatable within the clutch 22, those portions of the earring attached thereto including the second ornament, will enable the second ornament to be disposed at various angles with respect to the first ornament 12 as well as the wearer's ear. In the above manners, then, the second ornament may be disposed in varying angular relationships to the first ornament.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An earring for pierced ears comprising a post adapted to pass through the pierced ear opening, said post including a primary ornament at one end thereof and, a primary clutch for receipt of the other end of said primary post so as to support said earring from said ear, a secondary ornament secured to a secondary post, a sleeve forming a secondary clutch secured to said primary clutch, said secondary post slidably frictionally received in said secondary clutch whereby said secondary ornament is slidably adjustable towards and away from said primary ornament, said primary clutch rotatable about said primary post and said secondary post being rotatable about its longitudinal axis relative to said secondary clutch while mounted therein.

2. The earring of claim 1, said sleeve being elongated and oriented in the same direction as said secondary post, said passage adapted for receipt of said secondary post, the opening of said passage being of a similar cross-sectional and configuration as said secondary post but of a slightly smaller extent.

3. The earring of claim 2, said secondary post having a cap releasably secured to that end thereof opposite to said secondary ornament, said cap being of a greater lateral dimension than that of said sleeve opening so as to prevent accidental removal of said secondary post from said sleeve.

4. The earring of claim 2, said secondary post rotatable with respect to said sleeve.

5. The earring of claim 1, said primary ornament disposed adjacent the wearer's earlobe, said secondary ornament downwardly disposed from said primary ornament and adapted for positioning below said earlobe.

6. The earring of claim 1, said sleeve being open at opposite ends and including a radially deformable tube positioned therein and adapted to frictionally engage said primary post.

7. The earring of claim 1, said secondary ornament and the secondary post attached thereto being removable from said secondary clutch and replaceable with an alternate secondary ornament and attached post.

8. An earring for pierced ears comprising a post adapted to pass through the pierced ear opening, said post including a primary ornament at one end thereof and a primary clutch for receipt of the other end of said primary post so as to support said earring from said ear, a secondary ornament secured to a secondary post, a secondary clutch secured to said primary clutch, said secondary post adjustably received in said secondary clutch whereby said secondary ornament is adjustable towards and away from said primary ornament, said secondary clutch being a sleeve adapted to slidably frictionally receive said secondary post such that said secondary post is slidably adjustable with respect thereto, said primary clutch including a front plate having a generally central opening for receiving said primary post and a pair of rearwardly directed curled flanges disposed in opposition to each other and having portions adapted to frictionally contact side portions of said primary post to frictionally retain said post therein, one of said curled flanges receiving said sleeve.

9. The earring of claim 8, said sleeve fixedly attached to said one curled flange.

* * * * *